US005323990A

United States Patent [19]

Graves

[11] Patent Number: 5,323,990

[45] Date of Patent: Jun. 28, 1994

[54] LEAF RAMP AND BAG HOLDER DEVICE

[76] Inventor: David A. Graves, 3631 E. 55th St., Tulsa, Okla. 74135

[21] Appl. No.: 115,308

[22] Filed: Aug. 31, 1993

[51] Int. Cl.[5] ..... A63B 55/04

[52] U.S. Cl. ..... 248/97; 15/257.4; 141/370; 248/95

[58] Field of Search ..... 248/95, 97, 99, 100, 248/101, 98; 15/257.4, 257.9; 141/369, 370; 220/404, 908

[56] References Cited

U.S. PATENT DOCUMENTS

| | | | |
|---|---|---|---|
| 1,167,782 | 1/1916 | Richards . | |
| 2,827,931 | 3/1958 | Melvin | 141/369 X |
| 3,875,981 | 4/1975 | Brenner | 141/369 X |
| 4,240,474 | 12/1980 | Perkins | 141/231 |
| 4,442,567 | 4/1984 | Pravettone | 248/99 X |
| 4,479,344 | 10/1984 | Edwards | 53/390 |
| 4,530,533 | 7/1985 | Dieter | 294/1.1 |
| 4,697,834 | 10/1987 | Scott | 294/55 |
| 4,749,011 | 6/1988 | Rylander | 141/316 |
| 4,760,983 | 8/1988 | McNerney | 220/404 X |
| 4,832,291 | 5/1989 | Nelson | 248/99 |
| 4,984,758 | 1/1991 | Young | 248/95 |
| 5,031,277 | 7/1991 | Coker | 15/257.4 X |
| 5,040,754 | 8/1991 | Dearman | 15/257.4 X |
| 5,048,778 | 9/1991 | Wright | 248/98 |
| 5,119,960 | 6/1992 | Robbins | 220/908 X |
| 5,226,621 | 7/1993 | Skoff | 248/97 |

*Primary Examiner*—J. Franklin Foss

*Attorney, Agent, or Firm*—Catalano, Zingerman & McKay

[57] ABSTRACT

The present invention is a device for assisting a person in raking leaves into a vertically-oriented trash container. The device consists of a blunt-nosed ramp up which the leaves are raked using a conventional leaf rake. Once at the top of the ramp, the leaves fall by gravity through an opening provided in the device either into a trash bag previously secured to the opening by means of a lid portion or into a free-standing trash receptacle previously positioned under the opening. Rear legs provided on the device have pointed lower ends to anchor the device to the ground, and a food rest is provided at the front end of the device to hold the device against the ground while it is in use. An alternate embodiment of the device is capable of being folded for storage.

19 Claims, 4 Drawing Sheets

LEAF RAMP AND BAG HOLDER DEVICE

BACKGROUND OF THE INVENTION

1. Field of the Invention

The present invention relates to a device for raking leaves into a vertically-oriented trash container. More specifically, the present invention is a stationery ramp up which the leaves may be raked by means of a leaf rake or other similar device and which is provided with an opening at an uppermost end of the ramp around which an open end of a plastic trash bag can be secured or under which a free-standing trash receptacle can be positioned for receiving the leaves.

2. Description of the Related Art

In certain wooded regions of the country, autumn brings with it beautifully colored leaves which fall from the trees and accumulate on the ground. Often homeowners will, for either aesthetic or fire prevention reasons, choose to rake up and remove the leaves from their lawns. Traditionally, the leaves have been raked into a large pile and then the homeowner repeatedly stooped over to pick up armfuls of leaves which were placed in a vertically-oriented trash receptacle, usually a bushel basket, trash can or plastic trash bag which was held open by another person or by mechanical means. This job could become particularly difficult for someone with a large volume of leaves to remove or for someone who had a bad back.

To address these problems, various devices have been created for raking leaves into horizontally-oriented trash receptacles. However, a horizontally-oriented trash receptacle cannot be fully filled because the leaves tend to fall out the vertical opening or mouth of the trash receptacle. In addition, once the leaves have been raked into the horizontally-oriented trash receptacle, the trash receptacle must be pulled up and placed into a vertical position in order to secure the opening in the trash receptacle to prevent the leaves from falling out. In order to accomplish this, the homeowner must bend over and squat down which can result in back and leg strain. Another problem with these devices and their horizontally-oriented trash receptacles is that they tend to scoot along the ground as leaves are raked against them. Also, as the rake encounters these devices, the angle tips of the leaf rake's teeth tend to get caught between the ground and the device, causing the device to be pulled backward along the ground by the leaf rake.

The present invention addresses these problems by providing a device which allows the user to stand erect while raking leaves into a vertically-oriented trash receptacle. Because the trash receptacle is vertically-oriented, the user does not have to bend over or squat, and therefore, use of the device results in less back and leg strain. In addition, the vertically-oriented trash receptacle can be fully filled with leaves.

Also, to prevent the present invention from moving along the ground, it is provided with pointed rear legs which penetrate the ground. The present invention is also provided with a foot plate so that the user can place his foot on the foot plate to hold the device to the ground as he rakes leaves up the device's ramp and into the trash receptacle. The ramp on the present invention is additionally provided with a blunt portion at its lower end which prevents the angle tips of the leaf rake's teeth from getting caught thereunder.

Because the present invention may be attractive to children, optional bumps may be added to the ramp to make it uncomfortable for children to slide down the ramp. Alternately, the bumps may be omitted, step means may be added to the device, and the device may be made safe for children to play thereon when it is not being used to bag leaves.

SUMMARY OF THE INVENTION

The present invention is a leaf ramp and bag holder device. A continuous front end of the device rests on the ground and two rear legs, located at a rear end of the device, are provided with pointed lower ends which may be driven into the ground to help secure the device to the ground. Arched sides connect the front end to the rear legs. A horizontal foot plate extends rearward from a lower end of the front end and extends outward beyond the arched sides. A ramp lies between the arched sides at the front end of the device. The ramp extends from the lower end of the front end forming, consecutively, a generally vertical blunt portion, an elbow between the blunt portion and an upper angled ramp portion, and the angled ramp portion which extends upward and rearward, terminating at an upper ramp end. The sides are provided with ramp extensions which extend forward and upward from the ramp so as to form a chute for raking leaves up the ramp.

An opening is provided in the device just below and rearward of the upper ramp end. An upwardly-oriented rim provided circumferentially on the opening is provided with upwardly-oriented elongated holes. A detachable lid portion is provided with a central opening which is surrounded on either side and at the rear end with vertical extensions. The side extensions have forward extending wing extensions which are positioned on either side of the upper ramp end and the vertical ramp extensions when the lid portion is lowered onto the opening.

The central opening in the lid portion is provided circumferentially with two downwardly-oriented lips which are spaced apart so that the rim enters between the lips as the lid portion is lowered over the opening and onto the device. The lid portion is provided with pointed tips extending downwardly between the two lips. Each of the tips enters one of the elongated holes in the rim when the lid portion is secured to the device. A plastic trash bag can be secured to the device by first folding an open end of the bag over the rim and then securing the lid portion to the device. Handles are provided on the lid portion to assist the user in removing and reattaching the lid portion to the device. Optionally, step means may be added to the device to enable children to play on the device when it is not in use. Alternately, bumps may be provided on the ramp to discourage children from sliding down the ramp.

An alternate device which folds for storage may be made. The alternate device is provided with rear legs which can be adjusted in height to allow various heights of free-standing trash receptacles to be placed under the opening in the device. The rear legs of the alternate device lock in an operative position and unlock to fold forward to a folded storage position. The ramp of the alternate device is pivotally secured to frame members which connect the ramp to the rear legs. Likewise, the foot plate of the alternate device is pivotally secured to the lower end of the ramp. The ramp may be secured in an operative position by means of swivel eyebolt snaps. The swivel eyebolt snaps are permanently attached by means of eyebolts to the upper ramp end and are removably engageable with second eyebolts located on the frame members. The swivel eyebolt snaps are disengaged from the second eyebolts in order to allow the ramp to pivot so that the lower end swings rearwardly and the upper ramp end simultaneously swings forwardly until the ramp comes to rest in a folded storage position. The foot plate also pivots, swinging toward the ramp until it reaches a folded storage position.

DETAILED DESCRIPTION OF THE PREFERRED EMBODIMENT

Figure 1:
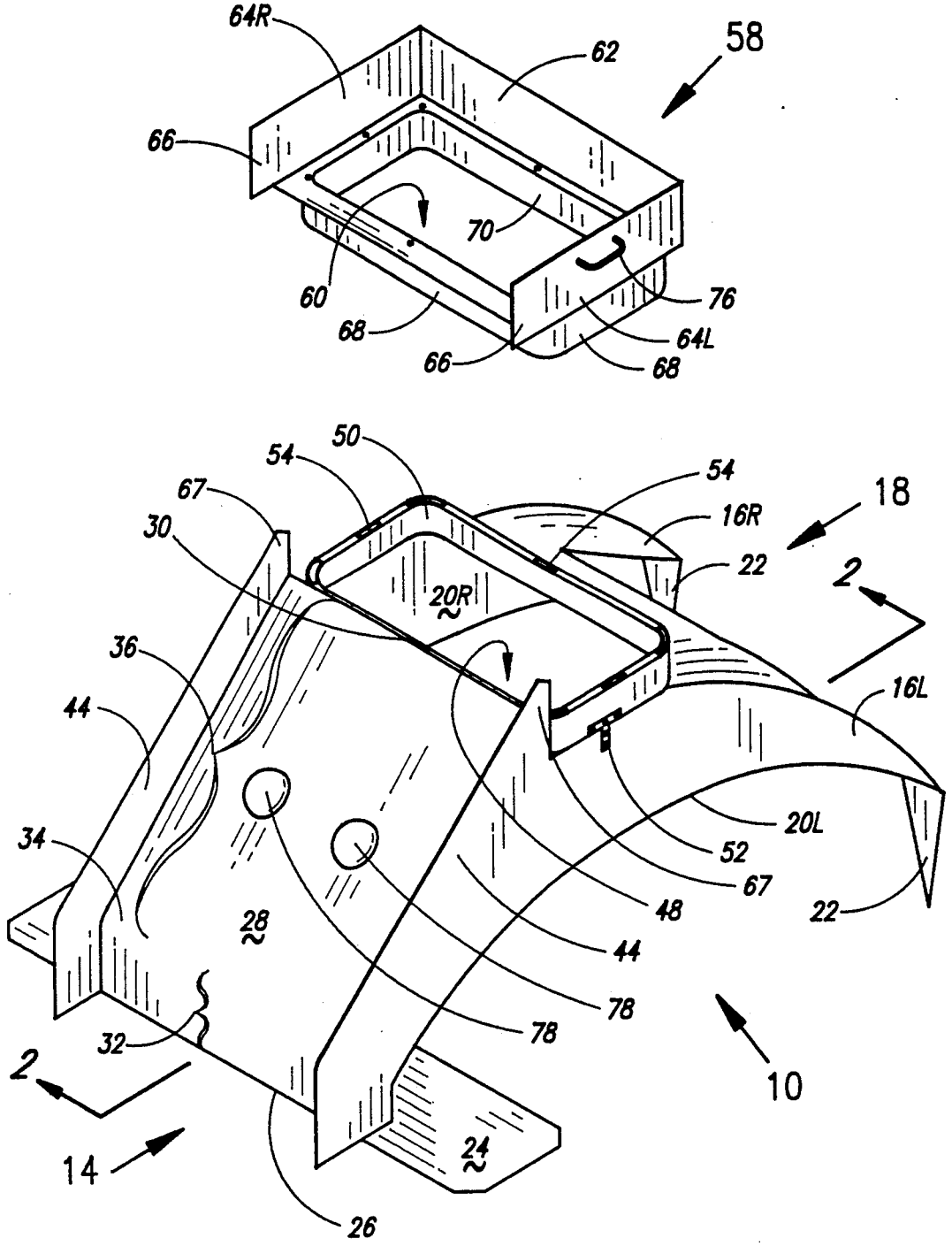
FIG. 1 is a left frontal perspective view of a leaf ramp and bag holder device constructed according to a preferred embodiment of the present invention showing the device with the lid portion detached.
Figures 2, 3:
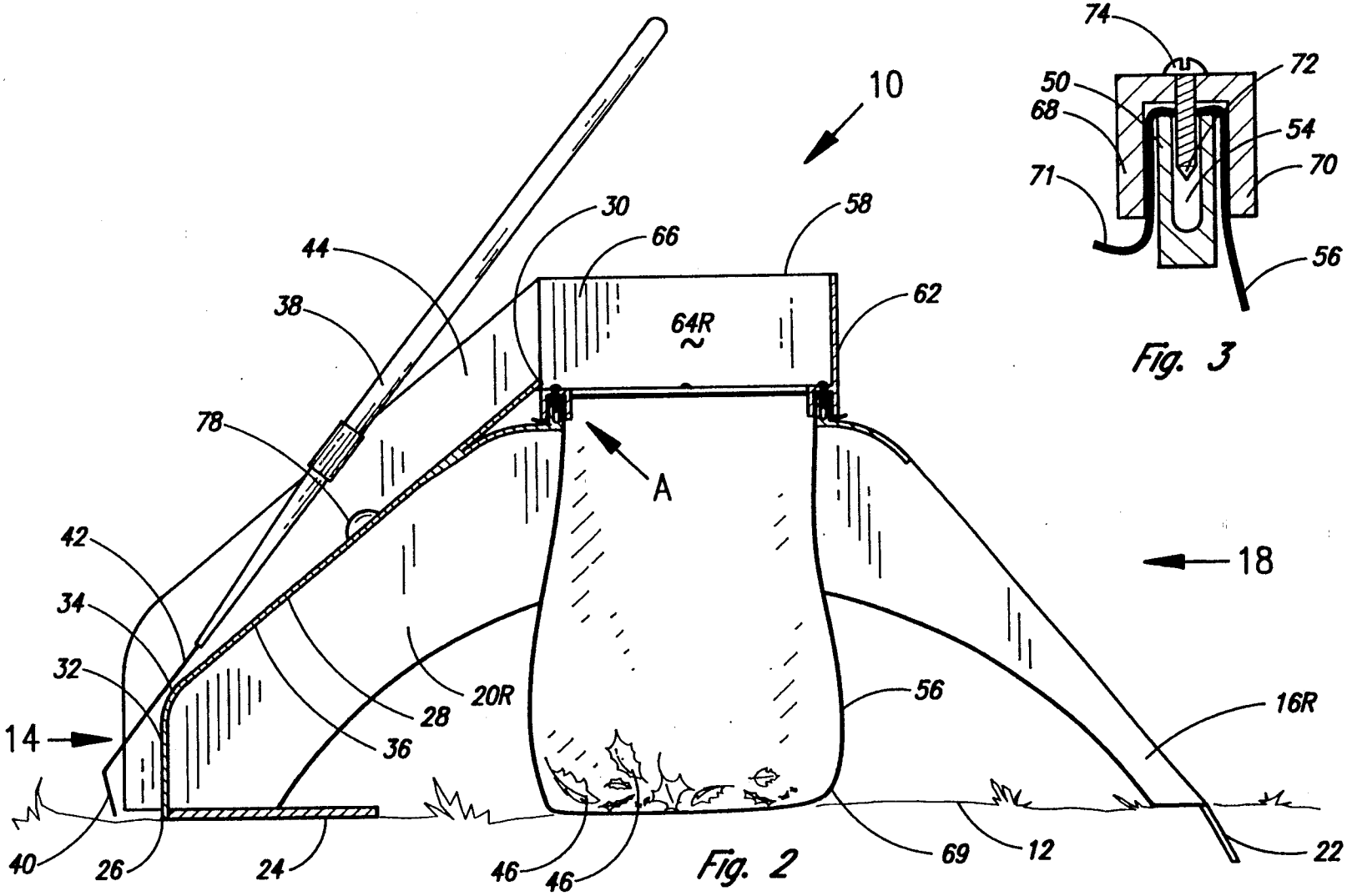
FIG. 2 is a cross-sectional view taken along line 2—2 of FIG. 1 showing the lid portion reattached to the device in order to secure a trash bag thereto and also illustrating how a leaf rake would be employed with the device.
FIG. 3 is an enlarged view of area A of FIG. 2 showing in detail the relationship between the lid portion, the trash bag and the rim of the opening.

Referring now to the drawings and initially to FIGS. 1 and 2, there is illustrated a leaf ramp and bag holder device 10 constructed according to a preferred embodiment of the present invention. The device 10 is designed to be supported above the ground 12 by means of a continuous front end 14 which engages the ground 12 and by means of two rear legs, a left rear leg 16L and a right rear leg 16R, located at a rear end 18 of the device 10 which also engage the ground 12. The front end 14 attaches to the rear legs 16L and 16R by means of arched vertical left and right sides 20L and 20R, respectively. A lower end 22 of each rear leg 16L and 16R is pointed so that the lower ends 22 can be pushed into the ground 12 and thereby help to secure the device 10 to the ground 12. In addition, a horizontal-oriented foot plate 24 attaches to a lower end 26 of the front end 14 so that the horizontal foot plate 24 extends rearward from the front end 14 and extends outward beyond both left and right sides 22L and 22R. When in use, a user (not illustrated) can place his or her foot (not illustrated) onto the foot plate 24 to help secure the device 10 to the ground 12.

The front end 14 is provided with a ramp 28 which contacts the ground 12 at the lower end 26 and extends at an angle upward and rearward until it terminates at an upper ramp end 30. The ramp 28 is provided with a blunt portion 32 located adjacent the lower end 26. The blunt portion 32 is generally vertical in orientation and an elbow 34 is formed in the ramp 28 where the blunt portion 32 and an angled ramp portion 36 meet. The angled ramp portion 36 extends between the elbow 34 and the upper ramp end 30.

The purpose of the blunt portion 32 is illustrated in FIG. 2. FIG. 2 shows a leaf rake 38 being pulled toward the ramp 28 by the user (not illustrated). The leaf rake 38 is normally provided with angle tips 40 on the teeth 42 of the rake 38. Since the ramp 28 is provided with a blunt portion 32, as the leaf rake 38 approaches the ramp 28, the teeth 42 encounter the elbow 34, thus preventing the angle tips 40 from reaching the lower end 26 of the front end 14, and thereby, preventing the angle tips 40 from catching under the device 10. As the leaf rake 38 continues to be pulled toward the device 10 after the teeth 42 contact the elbow 34, the angle tips 40 travel upward away from the lower end 26 until they reach the elbow 34. Thereafter the angle tips 40 travel along the angled ramp portion 36 until they reach the upper ramp end 30.

At intersections of the sides 20L and 20R with the ramp 28, each of the sides 20L and 20R are provided with a vertical ramp extension 44. The vertical ramp extensions 44 extend forward from the blunt portion 32 and upward from the angled ramp portion 36 so as to effectively form, in conjunction with the ramp 28, an upward-oriented chute. This chute allows the user (not illustrated) to rake leaves 46 up to the upper ramp end 30 without the leaves 46 falling off of the ramp 28.

The device is provided with an opening 48, preferably rectangular in dimension, generally located just rearward of the upper ramp end 30 and slightly below the upper ramp end 30. The opening 48 is provided circumferentially with an upward-oriented rim 50. The rim 50 may be molded in one piece with the ramp 28 and sides 20L and 20R of plastic or other suitable material, or alternately, as illustrated in FIG. 1, may be attached to the sides 20L and 20R by means of T-plates 52 or other suitable fasteners (not illustrated). The rim 50 is provided with upwardly-oriented elongated holes 54 whose function is in securing a plastic trash bag 56 to the rim 50 will be more fully described hereafter.

A removably attachable lid portion 58 is illustrated detached from the device 10 in FIG. 1 and reattached to the device 10 in FIG. 2. The lid portion 58 is provided with a central lid opening 60. A vertically-oriented rear extension 62 and left and right extensions 64L and 64R, respectively, attach to the lid portion 58 so that they surround the central opening 60 adjacent the left and right sides 20L and 20R and at the rear end 18. The rear extension 62 attaches on a left end to the left extension 64L and attaches on an opposite right end to the right extension 64R to form sideboards on the lid portion 58.

The left and right extensions 64L and 64R are each provided with a forwardly extending wing extension 66. The wing extensions 66 are spaced apart so that upper ends 67 of the vertical ramp extensions 44 lie between the wing extensions 66 when the lid portion 58 is attached to the device 10. By having the upper ends 67 of vertical ramp extensions 44 located between the wing extensions 66, the teeth 42 of the leaf rake 38 do not hang on the wing extensions 66 as the rake 38 is pulled upward along the ramp 28, thus allowing the leaves 46 to be funneled into the lid portion 58. When the leaves 46 enter the lid portion 58, the extensions 62, 64L and 64R funnel the leaves 46 so that they fall under the influence of gravity through the central lid opening 60, then through the opening 48 and finally into the attached plastic trash bag 56.

FIGS. 2 and 3 illustrate the attachment of the plastic trash bag 56 around the opening 48 by means of the lid portion 58. FIG. 3 is an enlarged view of an area designated by the letter "A" on FIG. 2. The plastic trash bag 56 is first placed through the opening 48 so that a closed end 69 of the plastic bag 56 extends downward to the ground 12. Then, an opposite open end 71 of the plastic trash bag 56 is slightly stretched and folded over the rim 50. The rim 50 is preferably sized to allow a standard 30-gallon plastic trash bag to snugly fit thereon, thus allowing the device 10 to be used with the trash bag 56 even without attaching the lid portion 58 to the device 10 in the event that the lid portion 58 is damaged, lost, or misplaced.

As best seen in cross-section in FIG. 3, a pair of downwardly-oriented lips, an external lip 68 and an internal lip 70, are provided on the lid portion 58 such that the lips 68 and 70 are located circumferentially with relationship to the central lid opening 60. Each of the lips 68 and 70 are continuous around the central lid opening 60, and the lips 68 and 70 are spaced apart from each other a sufficient distance so that the rim 50 enters therebetween as the lid portion 58 is lowered onto the device 10. The lid portion 58 is provided with a plurality of downwardly-oriented pointed tips 72 which are located between the lips 68 and 70. Each of the tips 72 mates with one of the elongated holes 54 provided in the rim 50. Preferably, the tips 72 are provided on self-tapping screws 74, as illustrated in FIG. 3. As the lid portion 58 is lowered onto the device 10, the tips 72 encounter the plastic trash bag 56 and pierce the through the bag 56 to enter their corresponding elongated holes 54, thereby attaching the lid portion 58 to the device 10 and also securing the plastic bag 56 in an upright position, as illustrated in FIG. 3, to the device 10. A handle 76 is provided on each of the left and right extensions 64L and 64R to enable the user (not illustrated) to grip the lid portion 58 in order to attach it to or remove it from the device 10.

Optionally, the device 10 may be provided with bumps 78 protruding from the angled ramp portion 36 of the ramp 28. The purpose of the bumps 78 is to make sliding down the ramp 28 uncomfortable to children (not illustrated) who might mistake the device 10 for a toy slide. The bumps 78 are rounded so that the teeth 42 of the leaf rake 38 do not hang on them, but instead, glide smoothly over them.

Alternately, the bumps 78 may be eliminated and step means (not illustrated) may be added to encourage children (not illustrated) to slide down the ramp 28 when the device 10 is not being employed to bag leaves 46. If the device 10 is modified for use as a toy for children, the lid portion 58 should be removed and all sharp edges on the device 10, including but not limited to the lower ends 22 of the rear legs 16L and 16R, should be rounded in order to make the device 10 safe for children.

Figure 4:
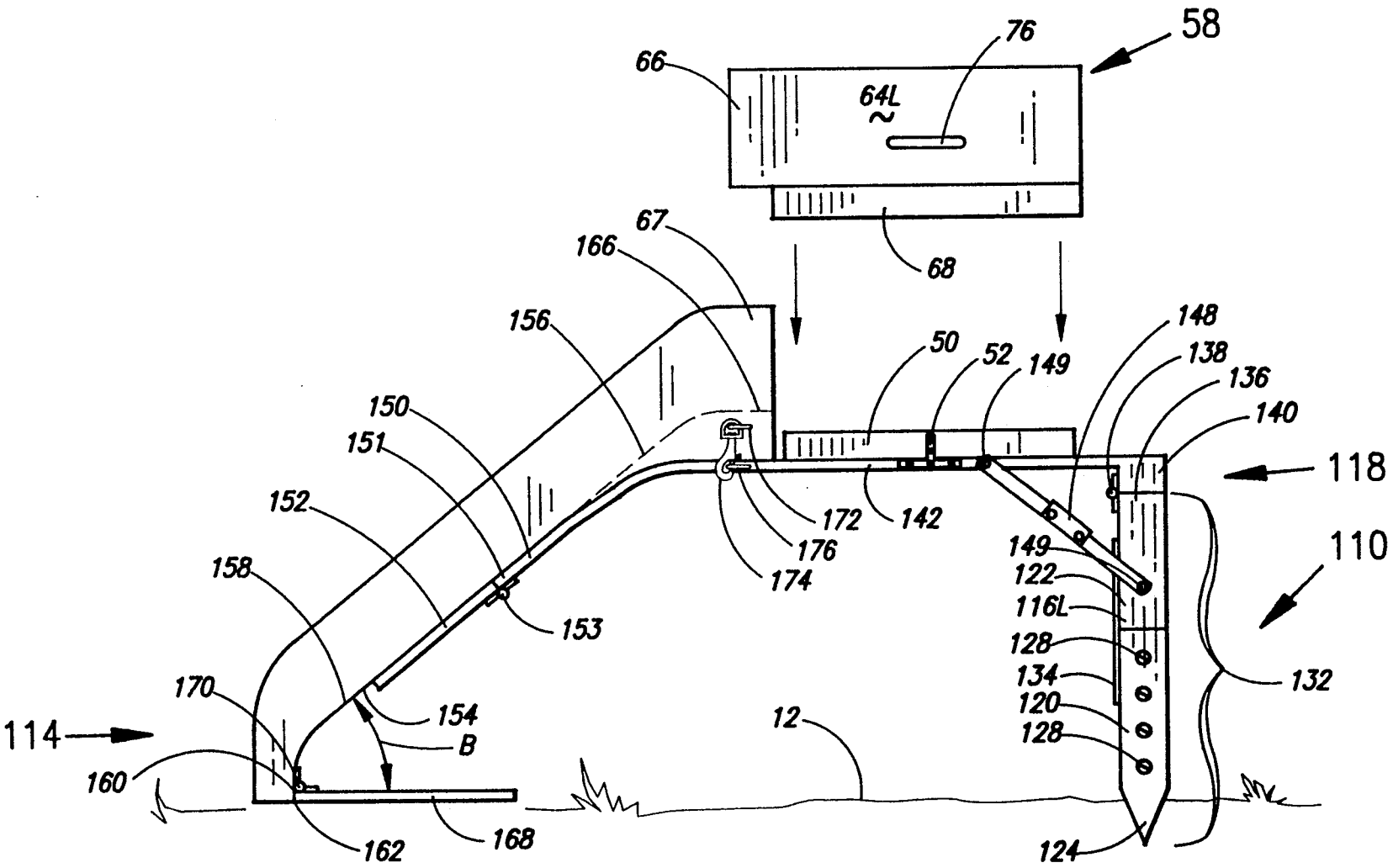
FIG. 4 is left side elevation of a foldable leaf ramp and bag holder device constructed according to another embodiment of the present invention and showing by use of arrows how the lid portion reattaches to the device.
Figures 5, 6:
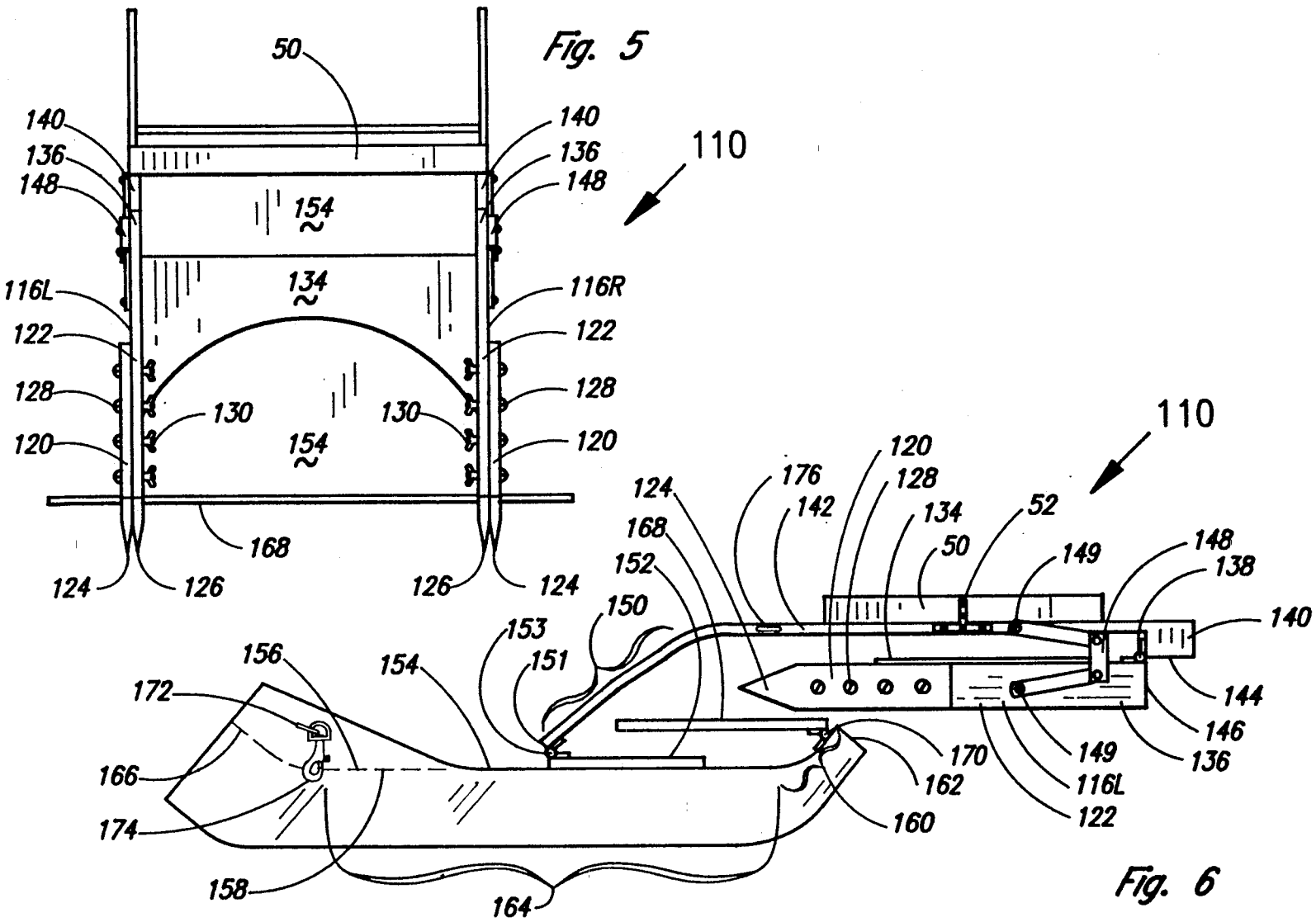
FIG. 5 is a rear elevation of the device of FIG. 4 showing the device with the lid portion removed.
FIG. 6 is a left side elevation of the device of FIG. 4 showing the device in its folded storage position.

Referring now to FIGS. 4, 5 and 6, there is illustrated an alternate embodiment leaf ramp and bag holder device 110. The alternate device 110 is foldable for storage and is adjustable in height to enable it to be used with various sizes of free-standing trash receptacles or containers (not illustrated) or to be used with the trash bag 56 as was discussed previously for device 10.

Similar to device 10, the alternate device 110 engages the ground 12 by means of a continuous front end 114 provided on the alternate device 110 and by means of left and right rear legs 116L and 116R, located at a rear end 118 of the alternate device 110. Each of the rear legs 116L and 116R is comprised of an adjustable lower short leg section 120 and an upper, longer leg section 122. The two upper, longer leg sections 122 are preferably located between the two lower leg sections 120.

As illustrated in FIGS. 4 and 5, each of the sections 120 and 122 is provided with a pointed lower end 124 and 126, respectively. Each of the lower, short leg sections 120 is adjustably secured to its corresponding upper, longer leg section 122 by means of bolts 128 which pass through pre-drilled holes (not illustrated) provided in both the leg sections 120 and 122. The bolts 128 are secured therein by wing nuts 130. In order to adjust total length 132 of the legs 116L and 116R, the wing nuts 130 are loosened, the bolts 128 are removed, and the lower leg sections 120 of each leg 116L and 116R are realigned so that the pre-drilled holes (not illustrated) of each of the lower, short leg sections 120 are aligned with different pre-drilled holes (not illustrated) provided in the upper longer leg sections 122, and thereby, either increasing or decreasing the length 132 of the legs 116L and 116R. The bolts 128 are then reinstalled through the aligned pre-drilled holes (not illustrated) and the wing nuts 130 are secured onto the bolts 128. The legs 116L and 116R are adjustable in order to raise or lower the alternate device 110 so that free-standing trash receptacles (not illustrated) of varying heights can be accommodated thereunder.

The rear legs 116L and 116R are connected together by means of a rear leg brace 134 which serves to stabilize the rear legs 116L and 116R as the pointed lower ends 124 and 126 are pushed into the ground 12 in order to help secure the alternate device 110 to the ground 12. The rear leg brace 134 secures to the upper longer leg sections 122 and is preferably secured to the leg sections 122 approximately midway down on the leg sections 122. Also, the rear leg brace 134 is preferably arched in configuration because an arched configuration tends to provide more stability to the legs 116L and 116R.

Upper ends 136 provided on each of the upper, longer leg sections 122 are secured by means of hinges 138 to rear portions 140 of side frame members 142. As illustrated in FIGS. 4 through 6, the rear portions 140 are provided with a wide downwardly facing surface 144 which engages an upwardly facing surface 146 provided on the upper end 136 of each of the upper, longer leg sections 122 when the rear legs 116L and 116R are fully extended to their operative position, as illustrated in FIGS. 4 and 5. A locking hinge 148 is provided on either side of the alternate device 110. Each locking hinge 148 attaches on one of its ends to the frame member 142 and on the other of its ends to the upper, longer leg section 122 approximately midway down section 122. Each of the locking hinges 148 attaches to its corresponding frame member 142 and to its corresponding upper, longer leg sections 122 by means of axle bolts 149 which allow both of the locking hinges 148 to rotate relative to the frame members 142 and relative to the upper, longer leg sections 122. The axle bolt 149 is secured by an axle nut (not illustrated).

The purpose of the locking hinges 148 is to lock the rear legs 116L and 116R in their fully extended operative position, as illustrated in FIGS. 4 and 5, while allowing the locking hinges 148 to be unlocked to fold the alternate device into its folded storage position with the rear legs 116L and 116R folded toward the frame members 142 at hinges 138 as illustrated in FIG. 6.

The alternate device 110 is provided with a rim 50 identical to the rim 50 of the device 10. The rim 50 secures to each of the frame members 142 by means of "T" plates 52 of other suitable fastening devices (not illustrated). Although not illustrated in FIGS. 4 through 6, the rim 50 of the alternate device 110 is provided with opening 48 and elongated holes 54 identical to those previously described for device 10. The lid portion 58 is also identical for both devices 10 and 110, and therefore, the previous description relating to the method by which the plastic trash bag 56 is secured to the device 10 also applies to the alternate device 110. Alternately, the alternate device 110 may be used with a free-standing trash container or receptacle (not illustrated), such as a trash can (not illustrated), which is positioned under opening 48 in order to catch leaves 46 instead of employing the trash bag 56.

Each of the frame members 142 is provided with a downwardly sloping front portion 150. A front end 151 of each front portion 150 secures by means of hinges 153 to a single front plate 152. The front plate 152 attaches to a rear-facing surface 154 of a ramp 156. The ramp 156 has a forward facing ramp surface 158 which is provided with a lower blunt portion 160. The lower blunt portion 160 engages the ground 12 at a lower end 162 of front end 114, and the lower blunt portion 160 is similar to the blunt portion 32 of device 10. The forward facing ramp surface 158 also is provided with an upper angled ramp portion 164 which extends upward and rearward to an upper ramp end 166, and the upper angled ramp portion 164 is similar to angled ramp portion 36 of device 10. Although not illustrated, the ramp 156 may be provided with bumps 78 identical to those described previously for device 10.

A horizontally-oriented foot plate 168 is pivotally attached to the lower end 162 of the front end 114, preferably by means of hinges 170, so that the foot plate 168 extends rearward from the lower end 162 and extends outward beyond the side frame members 142 of the alternate device 110, as best illustrated in FIGS. 4 and 5. Similar to foot plate 24 of device 10, the user (not illustrated) can step on foot plate 168 to secure device 110 to the ground 12. Because the foot plate 168 is movably attached to the lower end 162, an angle "B" which is formed between the foot plate 168 and the rear-facing surface 154 can increase or decrease in response to changes in the length 132 of legs 116L and 116R. Thus, the foot plate 168 remains in parallel alignment with the ground 12 regardless of how tall or how short the free-standing trash receptacle (not illustrated) is which is used in conjunction with the alternate device 110.

The upper ramp end 166 is provided on either side with an eyebolt 172 to which a swivel eyebolt snap 174 or other suitable fastener (not illustrated) is permanently attached. Each of the frame members 142 is provided with a second eyebolt 176 with which the corresponding swivel eyebolt snaps 174 removably engage in order to hold the ramp 156 in its fully extended, operative position, as illustrated in FIG. 4.

In order to fold the alternate device 110 into its folded storage position, the rear legs 116L and 116R are first unlocked and folded as previously described. Then, the swivel eyebolt snaps 174 are disengaged from the second eyebolts 176. Next, the foot plate 168 is pivoted at hinges 170 so that the foot plate 168 moves toward the rear-facing surface 154. Finally, the ramp 156 pivots at hinges 153 such that the lower end 162 swings rearward while the upper ramp end 166 simultaneously swings forward until the alternate device 110 is in its folded storage position, as illustrated in FIG. 6. The lid portion 58 may remain attached to the alternate device 110 for storage or may be removed, as shown in FIG. 6, and stored separately.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A device enabling a user to rake leaves into a vertically-oriented trash receptacle comprising:

a front end and an opposite rear end connected together by sides, at least one rear leg provided at the rear end, a lower end provided on the front end such that the lower end and each of the rear legs engage the ground to support the device above the ground, a sloped ramp extending between the lower end and an upper ramp end, and the device being provided with an opening located between the sides rearward of the upper ramp end so that leaves which are raked up the ramp and raked off the upper ramp end fall by gravity through the opening.

2. A device according to claim 1 further comprised of a blunt portion provided on the ramp at the lower end.

3. A device according the claim 1 further comprising a foot plate being attached to the lower end in order that a foot of a user may be placed thereon to secure the device to the ground.

4. A device according to claim 1 wherein each of the rear legs is provided with a pointed lower end which can be driven into the ground to secure the device to the ground.

5. A device according to claim 1 further comprising a lid portion removably engageable with the device at the opening so that a trash bag may be secured to the opening by the lid portion, said lid portion being provided with a central lid opening for admitting leaves into the trash bag.

6. A device according to claim 5 further comprising an upwardly-oriented continuous rim being provided circumferentially at the opening, said rim being provided with a plurality of upwardly-oriented elongated holes, two continuous downwardly-oriented lips being provided circumferentially at the central lid opening, said lips being spaced apart from each other so that the rim enters between the lips when the lid portion engages the device, a plurality of downwardly-oriented tips being provided on the lid portion between the lips such that each tip enters one of the elongated holes when the lid portion engages the device.

7. A device according to claim 5 further comprising vertical ramp extensions being provided on each side of the device adjacent the ramp, vertically-oriented extensions being provided on sides of the lid portion and at the rear end.

8. A device according to claim 1 further comprising at least one bump being provided on the ramp.

9. A device according to claim 1 wherein the sides are arched.

10. A device which is employed by a user in raking leaves into a vertically-oriented trash receptacle and which folds for storage after use, comprising:

a front end an opposite rear end connected together by frame members, adjustable height rear legs provided at the rear end, a lower end provided on the front end such that the lower end and the rear legs engage the ground to support the device above the ground, said legs being pivotally secured to said frame members, locking means for releasably locking the rear legs in an extended operative position, a sloped ramp provided at the front end, said ramp extending from the lower end upward to an opposite upper ramp end, a foot plate being pivotally attached to the lower end, a plate secured to a rear-facing surface provided on the ramp such that the plate is located between the lower end and the upper ramp end, said plate pivotally secured to the frame members, fastening means for releasably securing the upper ramp end to the frame members, and the device being provided with an opening located between the frame members rearward of the upper ramp end so that leaves which are raked up the ramp and raked off the upper ramp end fall by gravity through the opening.

11. A device according to claim 10 further comprising a blunt portion provided on the ramp at the lower end.

12. A device according to claim 10 wherein each of the rear legs is comprised of an upper longer leg section and a lower short leg section, each said lower short leg section is adjustably secured to its corresponding upper longer leg section, each lower short leg section is provided with a pointed lower end which can be driven into the ground to secure the device to the ground.

13. A device according to claim 10 further comprising a lid section removably engageable with the device at the opening so that a trash bag may be secured to the opening by the lid portion, said lid portion being provided with a central lid opening for admitting leaves into the trash bag.

14. A device according to claim 13 further comprising an upwardly-oriented continuous rim being provided circumferentially at the opening, said rim being provided with a plurality of upwardly-oriented elongated holes, two continuous downwardly-oriented lips being provided circumferentially at the central lid opening, said lips being spaced apart from each other so that the rim enters between the lips when the lid portion engages the device, a plurality of downwardly-oriented tips being provided on the lip portion between the lips such that each tip enters one of the elongated holes when the lid portion engages the device.

15. A device according to claim 13 further comprising vertical ramp extensions being provided on sides of the ramp, vertically-oriented extensions being provided on sides of the lid portion and at the rear end.

16. A device according to claim 10 further comprising at least one bump being provided on the ramp.

17. A device according to claim 10 wherein the frame members are spaced away from the ground so that a trash receptacle can be moved thereunder.

18. A device according to claim 10 wherein the fastening means for releasably securing the upper ramp end to the frame members comprises swivel eyebolt snaps.

19. A device according to claim 10 wherein the locking means for releasably locking the rear legs in an extended operative position comprises locking hinges pivotally secured between the rear legs and the frame members.

* * * * *